US010806226B2

(12) United States Patent
Silva et al.

(10) Patent No.: US 10,806,226 B2
(45) Date of Patent: Oct. 20, 2020

(54) SUITCASE SYSTEM

(71) Applicant: Ford Global Technologies, LLC, Dearborn, MI (US)

(72) Inventors: Magnovaldo Sampaio Silva, Salvador (BR); Giovana Collato Campanella, Lauro de Freitas (BR); Rafael Moreira, Salvador (BR); Thomaz Prado, Salvador (BR); Plattini Araujo, Salvador (BR)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 16/348,192

(22) PCT Filed: Nov. 8, 2016

(86) PCT No.: PCT/US2016/060917
§ 371 (c)(1),
(2) Date: May 8, 2019

(87) PCT Pub. No.: WO2018/088989
PCT Pub. Date: May 17, 2018

(65) Prior Publication Data

US 2019/0365065 A1 Dec. 5, 2019

(51) Int. Cl.
*A45C 9/00* (2006.01)
*A45C 5/14* (2006.01)
*A45C 13/16* (2006.01)

(52) U.S. Cl.
CPC ..... *A45C 9/00* (2013.01); *A45C 5/14* (2013.01); *A45C 13/16* (2013.01); *A45C 2009/007* (2013.01)

(58) Field of Classification Search
CPC ..... A45C 9/00; A45C 5/14; A45C 13/16
See application file for complete search history.

(56) References Cited

U.S. PATENT DOCUMENTS 4,162,024 A * 7/1979 Shanley ..... B65D 43/20 220/350
5,555,491 A * 9/1996 Tao ..... G06F 1/1632 361/679.43

(Continued)

FOREIGN PATENT DOCUMENTS

CN 204317762 U 5/2015
CN 205072275 U 3/2016

(Continued)

OTHER PUBLICATIONS

International Search Report and Written Opinion dated Jan. 25, 2017 re PCT/US2016/060917.

(Continued)

*Primary Examiner* — Brian L Swenson
(74) *Attorney, Agent, or Firm* — Brandon Hicks; Bejin Bieneman PLC

(57) ABSTRACT

A system includes a docking station and a suitcase. The docking station is installable in a cargo area of a vehicle and electrically connectable to a power source of the vehicle. The suitcase includes a port engageable with the docking station, a battery electrically connected to the port, an electric motor electrically connected to the battery, and a wheel connected to the electric motor.

16 Claims, 6 Drawing Sheets

(56) References Cited

U.S. PATENT DOCUMENTS

| | | | | |
|---|---|---|---|---|
| 5,878,829 | A | 3/1999 | Kanno et al. | |
| 5,966,285 | A | 10/1999 | Sellers | |
| 7,978,466 | B2 * | 7/2011 | Lewandowski | G06F 1/1632 361/679.41 |
| 8,434,577 | B1 | 5/2013 | Al-Qaffas | |
| 8,901,875 | B2 | 12/2014 | Schuessler | |
| 9,027,722 | B1 * | 5/2015 | Parker | A45C 5/14 190/102 |
| 9,770,084 | B1 * | 9/2017 | Shiekh | A45C 13/28 |
| 2005/0000964 | A1 * | 1/2005 | Morszeck | A45C 13/16 220/345.5 |
| 2007/0131462 | A1 | 6/2007 | Hemsley | |
| 2009/0072782 | A1 | 3/2009 | Randall | |
| 2012/0325607 | A1 * | 12/2012 | Webster | A45C 5/143 190/115 |
| 2014/0116413 | A1 * | 5/2014 | Brown | A45F 3/46 126/276 |
| 2015/0348347 | A1 | 12/2015 | Diz et al. | |
| 2016/0229437 | A1 * | 8/2016 | Jackman | B62B 5/0073 |
| 2018/0184777 | A1 * | 7/2018 | Hong | A45C 13/005 |
| 2018/0255894 | A1 * | 9/2018 | Knittel | A45C 3/06 |
| 2019/0373998 | A1 * | 12/2019 | Knittel | G08B 5/22 |

FOREIGN PATENT DOCUMENTS

| | | | |
|---|---|---|---|
| KR | 200458132 | Y1 | 1/2012 |
| KR | 1020120043510 | A | 5/2012 |

OTHER PUBLICATIONS

Clark, "Live Luggage power Assisted suitcase", Jun. 24, 2008; http://www.gizmag.com/live-luggage-power-assisted-suitcase/9522/.

Parrack, "Trunkster rolls up to baggage claim with GPS battery and integrated scale", Nov. 29, 2014; http://www.gizmag.com/trunkster-luggage/34979/.

* cited by examiner

SUITCASE SYSTEM

BACKGROUND

One type of luggage useful for air travel is roller bags. A roller bag may be the shape of a rectangular prism. A door on a front side of the roller bag is opened and closed, for example, with a zipper extending along three sides of the door. The roller bag may include a telescoping handle extendable from a top edge of a rear side. The roller bag may include two wheels on an edge between the rear side and a bottom side. The wheels may be freely rotatable relative to the roller bag.

DETAILED DESCRIPTION

Figure 1:
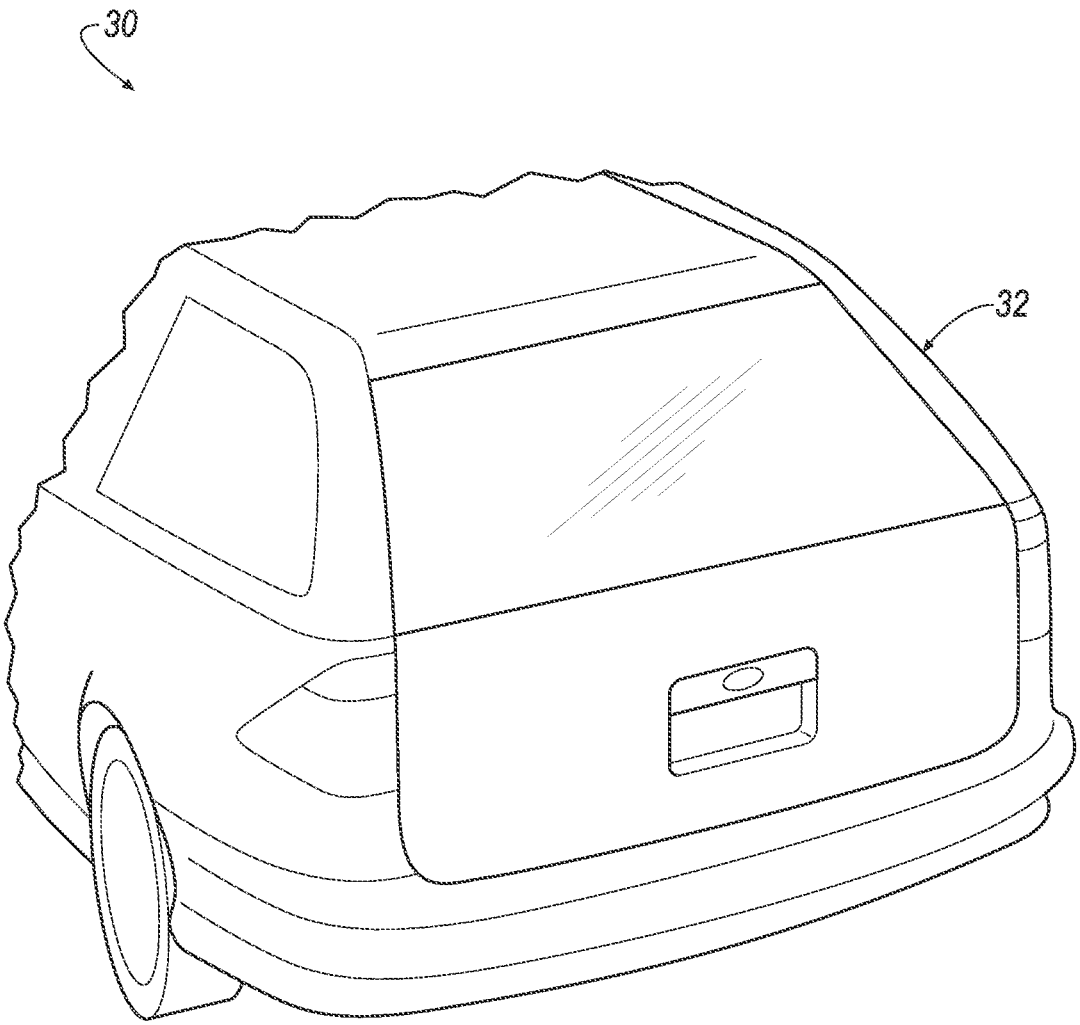
FIG. 1 is a rear perspective view of a vehicle.

With reference to the Figures, wherein like numerals indicate like parts throughout the several views, a system 30 includes a docking station 34 and a suitcase 36. The docking station 34 is installable in a cargo area 38 of a vehicle 32 and electrically connectable to a power source 40 of the vehicle 32. The suitcase 36 includes a port 42 engageable with the docking station 34, a battery 44 electrically connected to the port 42, an electric motor 46 electrically connected to the battery 44, and a wheel 48 connected to the electric motor 46.

The system 30 assists a user with moving the suitcase 36. This assistance is particularly useful for users who are disabled, elderly, pregnant, and so on. The system 30 coordinates with the vehicle 32 to provide convenience for the user by charging the battery 44 of the suitcase 36 while, e.g., the user is driving the vehicle 32. When not being used as a suitcase, the suitcase 36 can serve as a storage bin within the cargo area 38 of the vehicle 32.

With reference to FIG. 1, the vehicle 32 may be a motor vehicle such as an automobile, sedan, coupe, van, minivan, truck, sport utility vehicle, etc. The vehicle 32 may use a known vehicle propulsion subsystem (not shown), for example, a conventional powertrain including an internal-combustion engine coupled to a transmission that transfers rotational motion to wheels; an electric powertrain including batteries, an electric motor, and a transmission that transfers rotational motion to the wheels; a hybrid powertrain including elements of the conventional powertrain and the electric powertrain; or any other type of propulsion.

Figure 2:
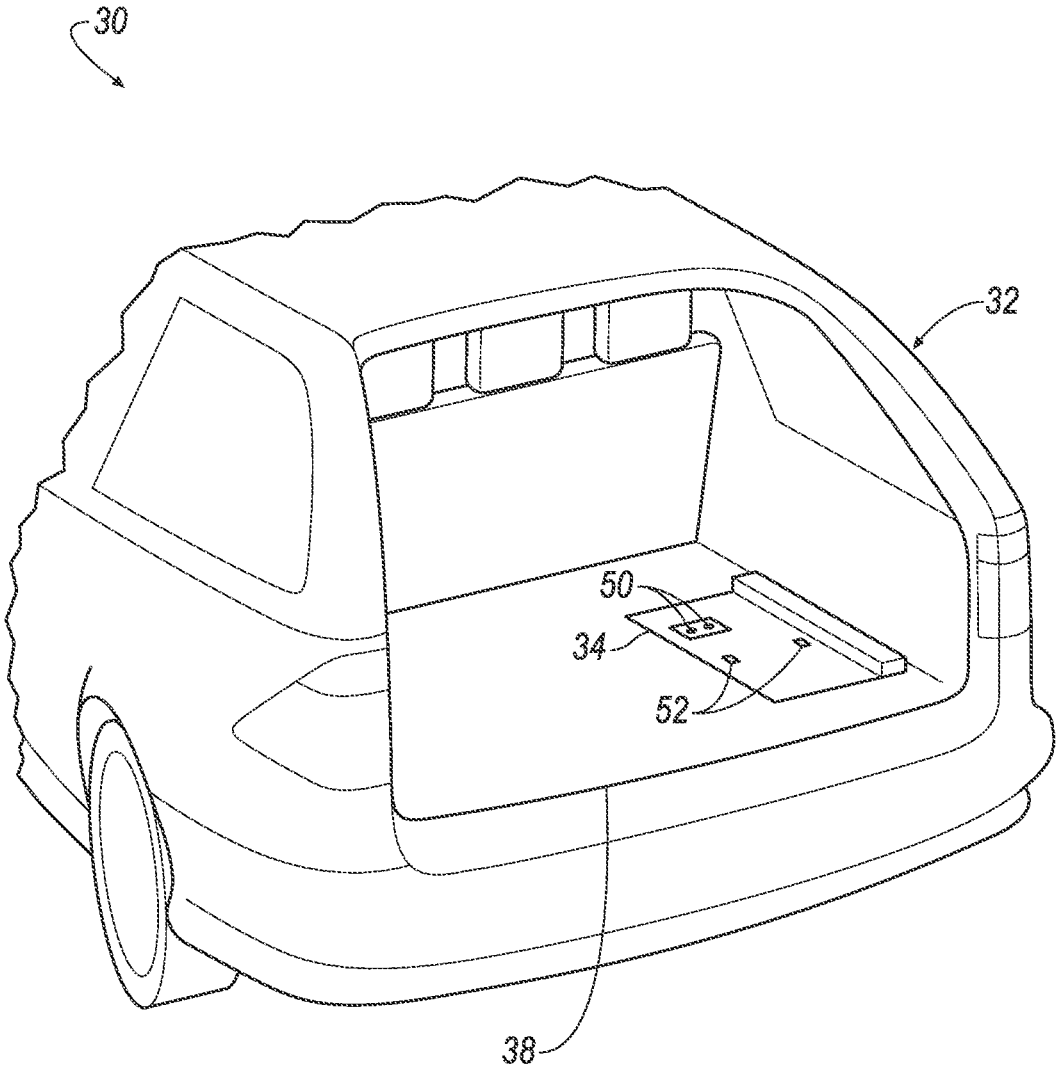
FIG. 2 is a rear perspective view of the vehicle with a trunk lid removed for illustrative purposes.
Figure 3:
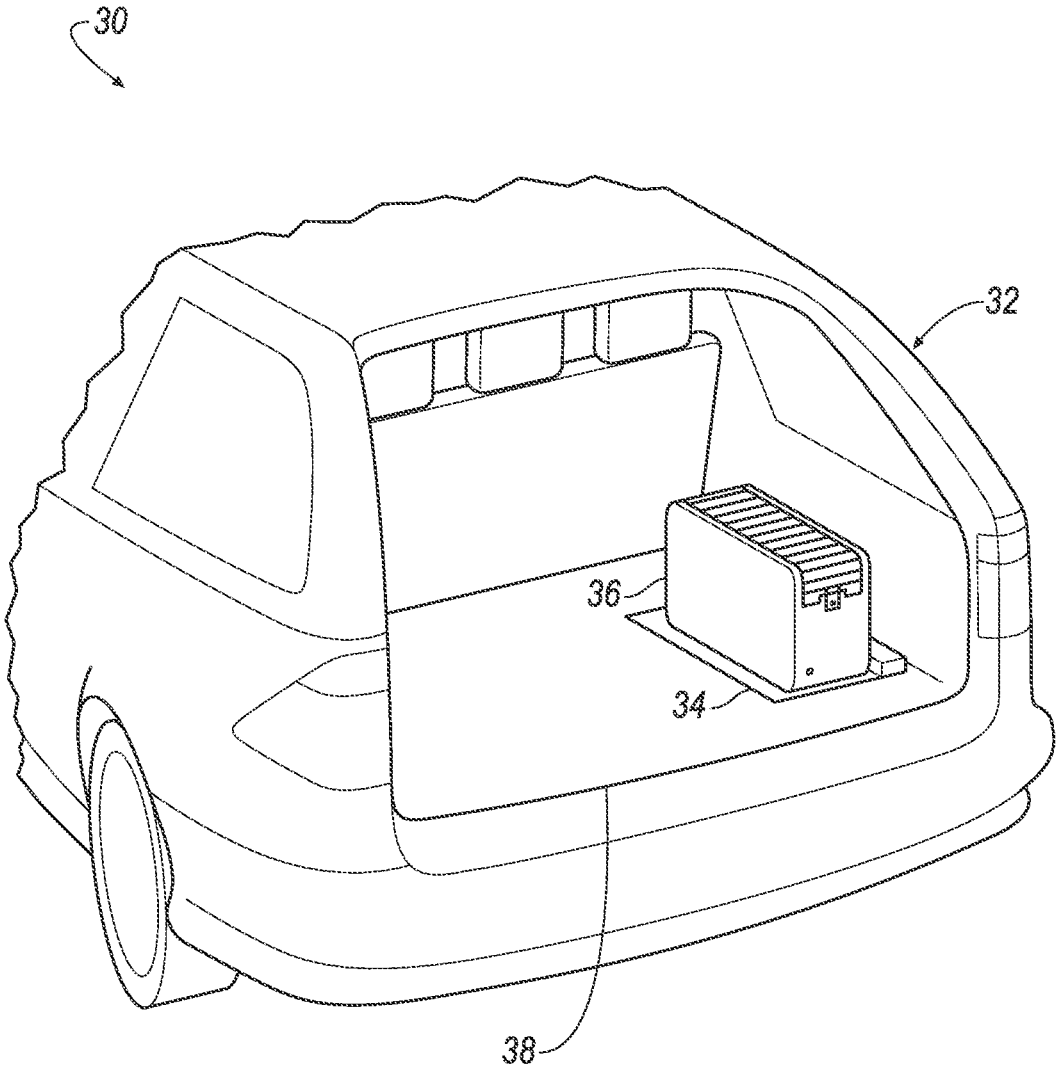
FIG. 3 is a rear perspective view of the vehicle with the trunk lid removed and containing a suitcase.

With reference to FIGS. 2 and 3, the vehicle 32 includes the cargo area 38. The cargo area 38 is a space in the vehicle 32 whose purpose is carrying cargo. The cargo area 38 may be dedicated to carrying cargo, e.g., a trunk. Alternatively, the cargo area 38 may be configurable between a cargo-carrying state and another state; for example, floor space below a removable seat (not shown) may be in a cargo-carrying state when the seat is absent and in a passenger-carrying state when the seat is present.

Figure 4:
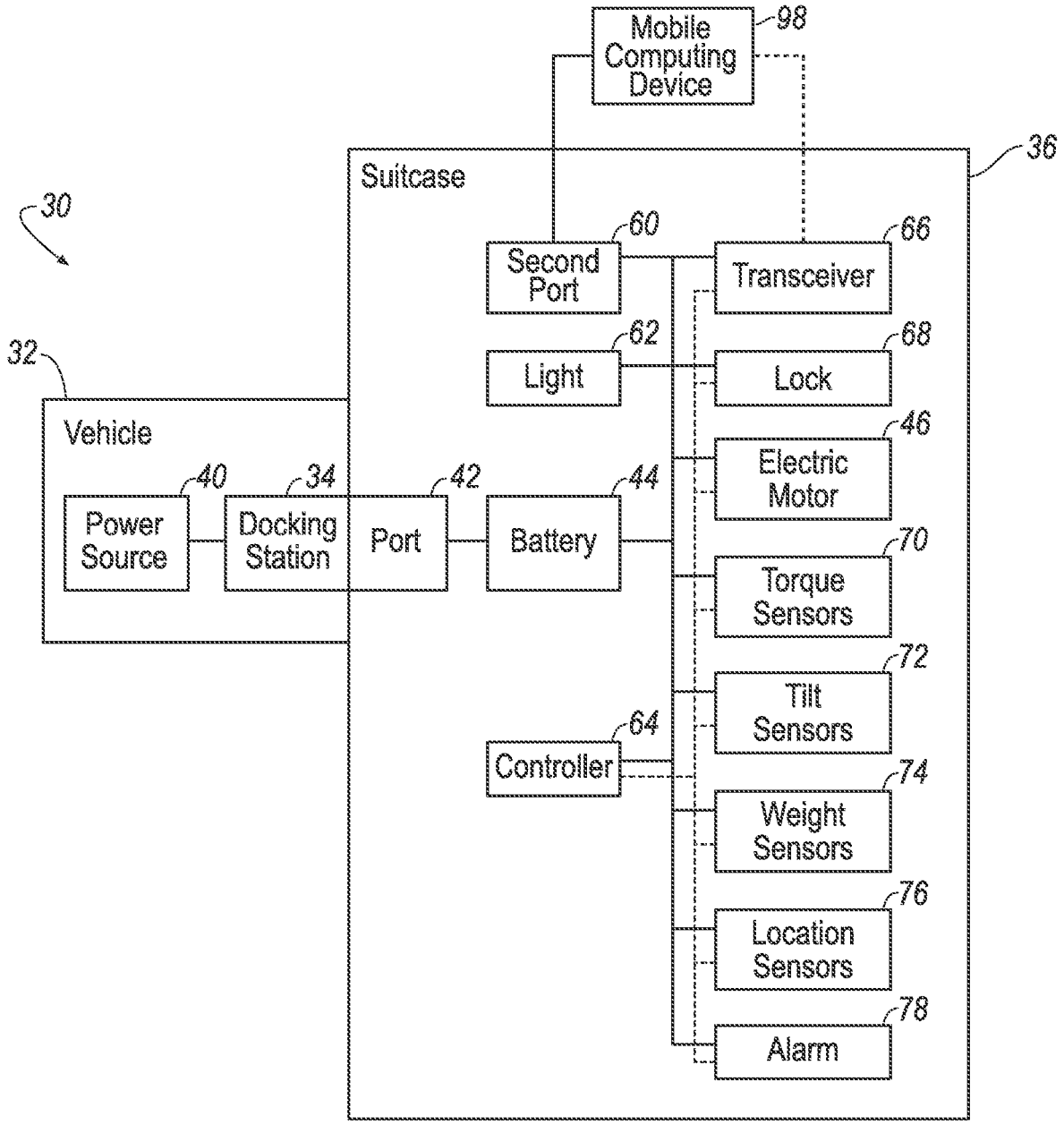
FIG. 4 is a block diagram of the vehicle and the suitcase.

With reference to FIG. 4, the power source 40 makes electrical energy available to components to which the power source 40 is connected. The power source 40 may store electrical energy, for example, a battery connected to the conventional, electric, or hybrid powertrain.

With reference to FIGS. 2-4, the docking station 34 is installable in the cargo area 38 of the vehicle 32. The docking station 34 is electrically connectable to the power source 40 of the vehicle 32. The docking station 34 may include leads 50 connectable to the power source 40.

The docking station 34 includes engagement features for engaging the suitcase. As one example, the docking station 34 may include clips 52 that are engageable with the suitcase 36, as described further below. Alternatively or additionally, the docking station 34 may include guide rails, tie straps, magnets, etc., for engaging the suitcase 36 with the docking station 34 in a particular position relative to the docking station 34.

With reference to FIGS. 4-7, the suitcase 36 includes an exterior 54 and a door 56 collectively defining a cavity 58. The suitcase 36 may include the battery 44 and the port 42, a second port 60, a light 62, a controller 64 (i.e., a computing system), a transceiver 66, a lock 68, the electric motor 46, torque sensors 70, a tilt sensor 72, a weight sensor 74, a location sensor 76, and an alarm 78, all electrically connected to the battery 44. The controller 64 is in communication with the transceiver 66, the lock 68, the electric motor 46, the torque sensors 70, the tilt sensor 72, the weight sensor 74, the location sensor 76, and the alarm 78. The electric motor 46 is connected to the wheels 48.

Figure 5:
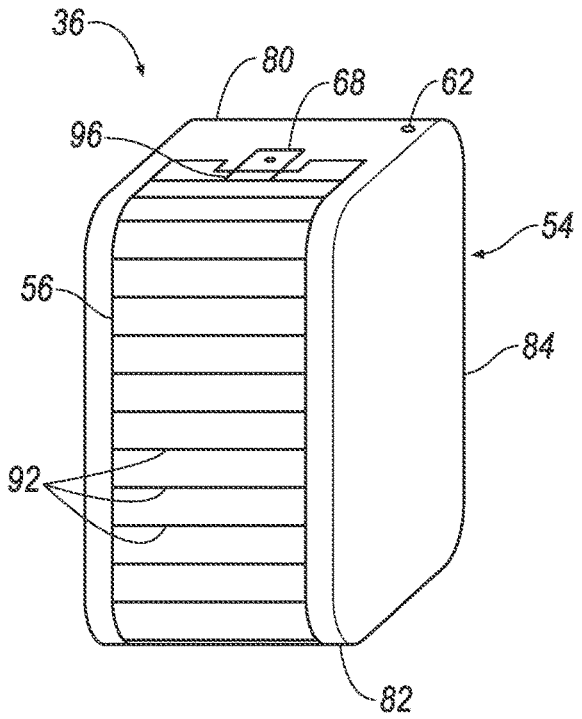
FIG. 5 is a front perspective view of the suitcase in a closed state.
Figure 6:
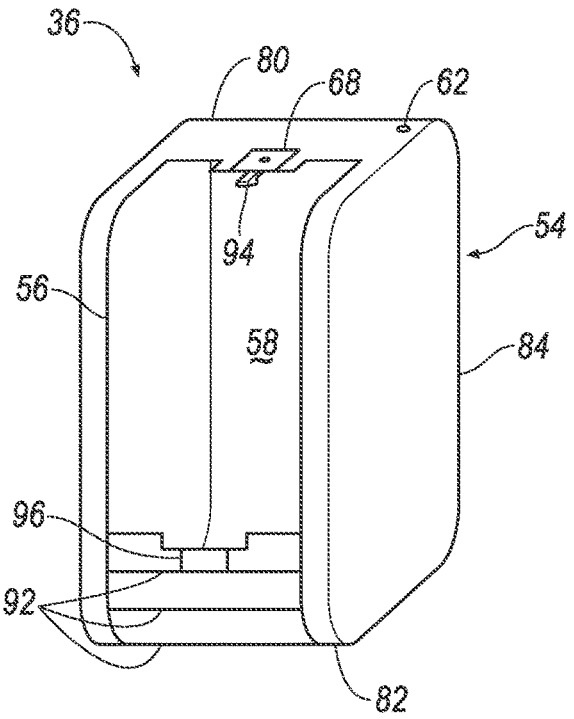
FIG. 6 is a front perspective view of the suitcase in an opened state.
Figure 7:
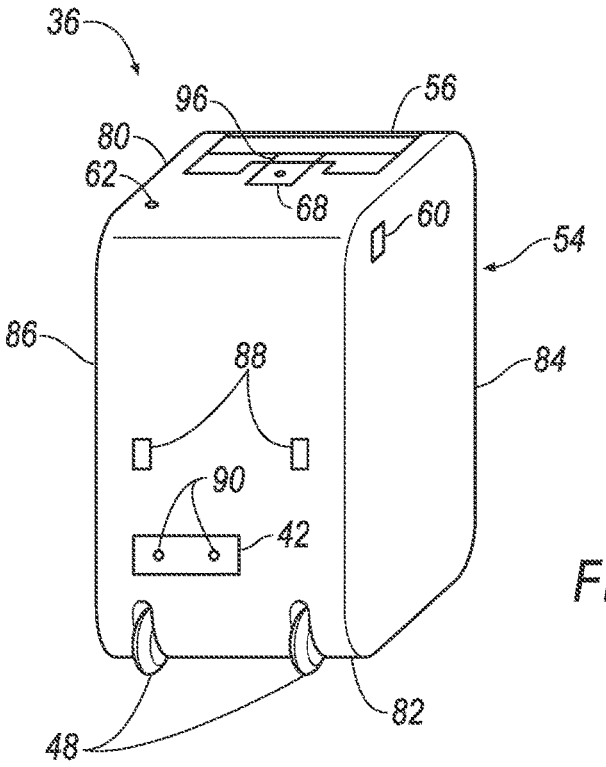
FIG. 7 is a rear perspective view of the suitcase.

With reference to FIGS. 5-7, the exterior 54 of the suitcase 36 includes a plurality of walls 80, 82, 84, 86 constituting the suitcase 36. Specifically, the suitcase 36 may include a top wall 80, a bottom wall 82, side walls 84, and a rear wall 86. The suitcase 36 may have the shape of a rectangular prism, with the top wall 80 opposite the bottom wall 82, the side walls 84 opposite each other, and the rear wall 86 opposite the door 56. The exterior 54, e.g., the rear wall 86, may include slots 88 positioned for receiving the clips 52 of the docking station 34.

With reference to FIG. 6, the cavity 58 is a space inside the suitcase 36. A user of the suitcase 36 may use the cavity 58 for storage.

With reference to FIGS. 5 and 6, the door 56 is movable relative to the exterior 54 between an opened position, as shown in FIG. 5, and a closed position, as shown in FIG. 6. In the closed position, the door 56 is opposite the rear wall 86 and encloses the cavity 58, as shown in FIG. 5. In the opened position, the door 56 is retracted along the exterior 54 and reveals the cavity 58, as shown in FIG. 6, to provide access to the cavity 58. The door 56 may be a tambour door. Specifically, the door 56 includes door segments 92 parallel along a lateral direction relative to the door 56. The door segments 92 are flexibly connected in series in a longitudinal direction relative to the door 56. When the door 56 moves from the closed position to the opened position, the door segments 92 slide along the exterior 54 of the suitcase 36 so that the door 56 conforms to a shape of the exterior 54.

With reference to FIGS. 2 and 7, the port 42 is engageable with the docking station 34. The port 42 may be attached to the rear wall 86 of the exterior 54 of the suitcase 36. The port 42 may have leads 90 connect to the leads 50 of the docking station 34 when the port 42 is engaged with the docking station 34. An arrangement of the leads 90 of the port 42 may correspond to an arrangement of the leads 50 of the docking station 34; for example, as shown in FIGS. 2 and 7, the port 42 has two leads 90 spaced a distance apart, and the docking station 34 has two leads 50 spaced the same distance apart. When the leads 90 of the port 42 are connected to the leads 50 of the docking station 34, the leads 50, 90 create an electrical path between the docking station 34 and the suitcase 36.

With reference to FIG. 4, the battery 44 is electrically connected to the port 42. The battery 44 receives electrical energy from the port 42 when the port 42 is engaged with the docking station 34 and thus connected to the power source 40 of the vehicle 32. The battery 44 may be of any suitable type for storing sufficient charge for the activities described below, for example, lithium-ion batteries, nickel-metal hydride batteries, lead-acid batteries, or ultracapacitors.

The controller 64 may be a microprocessor-based controller. The controller 64 may include a processor, memory, etc. The memory of the controller 64 may include memory for storing instructions executable by the processor as well as for electronically storing data and/or databases.

The transceiver 66 may be adapted to transmit and receive signals wirelessly through any suitable wireless communication protocol, such as Bluetooth, WiFi, 802.11a/b/g, radio, etc. The transceiver 66 may be adapted to communicate with a remote server, that is, a server distinct and spaced from the suitcase 36. The remote server may be located outside the suitcase 36. Alternatively, the transceiver 66 may be a separate transmitter and receiver.

With reference to FIGS. 4-6, the lock 68 is movable between a locked position engaged with the exterior 54 and the door 56 in the closed position and an unlocked position disengaged with at least one of the exterior 54 and the door 56. For example, the lock 68 may be attached to the door 56 and include a latch 94 that mates with a receiver 96 attached to the exterior 54. The latch 94 and the receiver 96 may be in proximity to mate when the door 56 is in the closed position.

The lock 68 may be movable to the unlocked position via a master key and one of a personal key and a combination. The master key is usable with all copies of the lock 68 that the manufacturer fabricates and is typically not provided to an end user. The personal key is usable only with one copy or a small number of copies of the lock 68 and is provided to the end user along with purchase of the lock 68 and/or the suitcase 36. The combination is a sequence of numbers provided to the end user with purchase of the lock 68 and/or the suitcase 36. The lock 68 may include, e.g., a plurality of rotatable, numbered dials (not shown) through which the end user can enter the combination.

The lock 68 may be in communication with the controller 64. The lock 68 may be configured to be movable between the unlocked position and the locked position in response to a signal from the controller 64. For example, the lock 68 may include a servo (not shown) in communication that the controller 64 that moves the latch 94 to engage or disengage the receiver 96 in response to a signal from the controller 64.

With reference to FIG. 7, the suitcase 36 may include two wheels 48. The wheels 48 may be disposed at an edge between the bottom wall 82 and the rear wall 86. The wheels 48 may be spaced from each other toward corners of the suitcase 36. The wheels 48 may be formed of plastic or rubber.

With reference to FIG. 4, the suitcase 36 may include one or two electric motors 46. The electric motor 46 is electrically connected to the battery 44 and connected to one or both of the wheels 48. The electric motor 46 may be drivably connected to the wheel or wheels 48. The electric motor 46 may be attached to the rear wall 86, disposed in the wheel 48, or located anywhere that facilitates a drivable connection to the wheel 48.

The torque sensors 70 may be connected to the wheels 48. One torque sensor 70 may be connected to each wheel 48. The torque sensors 70 may be configured to detect a torque applied to the wheels 48 relative to the exterior 54. The torque sensors 70 may transmit a signal to the controller 64 based on the detected torque. The torque sensors 70 may be any suitable sensor capable of detecting torque of a rotating component, such as torque transducers or magnetoelastic torque sensors.

The tilt sensor 72 may be in communication with the controller 64. The tilt sensor 72 may transmit a tilt signal to the controller 64 based on an angle of the suitcase 36 relative to a direction of gravity. The tilt sensor 72, also referred to as an inclinometer, may be any sensor capable of detecting an angle relative to the direction of gravity, such as accelerometer, liquid capacitive, electrolytic, gas bubble in liquid, or pendulum.

The weight sensor 74 may be in communication with the controller 64. The weight sensor 74 may transmit a weight signal to the controller 64 based on a sensed weight of the suitcase 36. The weight sensor 74 may be connected to the wheel 48, and another weight sensor 74 may be attached to the other wheel 48. The weight sensor 74 may be any sensor capable of detecting a force against gravity, such as spring scale, load cell, or strain gauge.

The location sensor 76 may be in communication with the controller 64. The location sensor 76 may be any sensor capable of determining a geospatial location of the suitcase 36, such as a Global Positioning System (GPS) sensor.

The alarm 78 may be in communication with the controller 64. The alarm 78 may be capable of producing a sound in response to a signal from the controller 64.

With reference to FIGS. 4-7, the light 62 may be in communication with the battery 44. The light 62 may be programmed to illuminate based on a state of charge of the battery 44. For example, the light 62 may change color depending on a state of charge, such as green for greater than 50% charge, yellow for 25% to 50% charge, and red for less than 25% charge. For another example, the light 62 may include multiple bulbs, and a number of bulbs illuminated may depend on the state charge, such four bulbs for greater than 75% charge, three bulbs for 50% to 75% charge, two bulbs for 25% to 50% charge, and one bulb for less than 25% charge. The light 62 may be any suitable type for legibility by a user, such as light-emitting diodes (LED).

With reference to FIGS. 4 and 7, the second port 60 may be electrically connected to the battery 44. The second port 60 may be engageable with a mobile computing device 98, e.g., a smartphone or tablet. The second port 60 may be, for example, a connector satisfying a standard such as micro-USB. The second port 60 may be used to charge the mobile computing device 98 with electrical energy from the battery 44.

With reference to FIGS. 2 and 3, the suitcase 36 may be detachably attached to the docking station 34 via, e.g., the clips 52 of the docking station 34 in the slots 88 of the suitcase 36. When the suitcase 36 is attached to the docking station 34, the port 42 is engaged to the docking station 34. Specifically, the leads 90 of the port 42 are connected to the leads 50 of the docking station 34, creating an electrical path between the docking station 34 and the suitcase 36. The battery 44 of the suitcase 36 can recharge using electrical energy from the power source 40 of the vehicle 32. Recharging may occur, for example, while a user is driving the vehicle 32 to a destination at which the user will use the suitcase 36, e.g., an airport.

Figure 8:
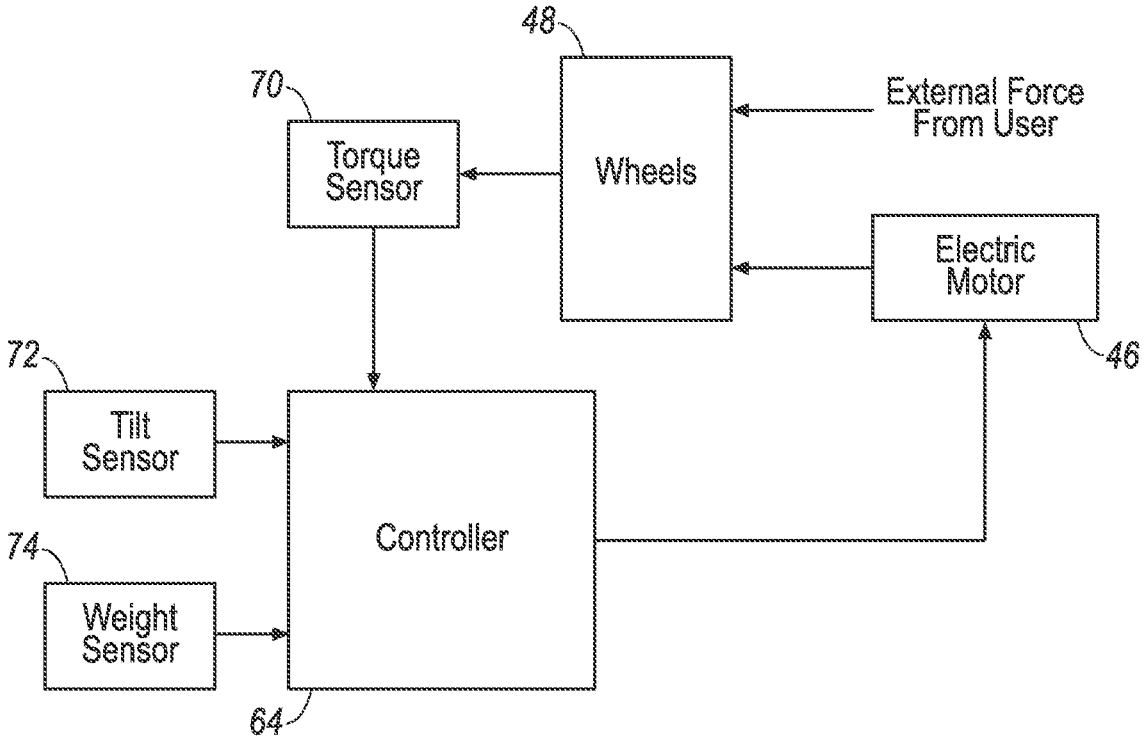
FIG. 8 is a control-loop diagram for the suitcase.

With reference to FIG. 8, the controller 64 may be programmed to instruct the electric motor 46 to rotate the wheel 48 based at least on torque applied to the wheel 48 as determined by the torque sensors 70, a tilt signal from the tilt sensor 72, and/or a weight signal from the weight sensor 74. When a user applies an external force to the wheels 48 by, e.g., pulling the suitcase 36 through an airport, the torque sensor 70 detects torque through the wheel 48 and transmits a torque signal to the controller 64. The controller 64 may increase a speed of the electric motor 46 in response to increased torque. When a user tilts the suitcase 36, the tilt sensor 72 detects the tilt and transmits the tilt signal to the controller 64. The controller 64 may increase a speed of the electric motor 46 in response to a greater value of the tilt signal. When the suitcase 36 is heavier, the weight sensor 74 may transmit the weight signal to the controller 64. The controller 64 may increase a speed of the electric motor 46 in response to a greater weight. For example, the controller 64 may be programmed to set the speed of the electric motor 46 based on the torque signal, the tilt signal, and the weight signal, for example, $S=k*T*I*(W+c)$, in which S is the speed of the electric motor 46, k is a constant scaling factor, T is torque determined from the torque signal, I is an incline of the suitcase 36 relative to vertical determined from the tilt signal, W is a weight determined from the weight signal, and c is a constant adjustment factor for the weight. While in this example the speed of the electric motor 46 is linear with respect to the torque signal, tilt signal, and weight signal, other relationships may be used.

The controller 64 may be programmed to instruct the transceiver 66 to send a signal indicating a weight of the suitcase 36 based on the weight signal from the weight sensor 74. The signal may be sent from the transceiver 66 to, e.g., the mobile computing device 98 of the user. The user may choose to, e.g., reduce the weight of the suitcase 36 by removing items from the cavity 58 to ensure the suitcase 36 is below a weight limit set by an airline. Alternatively or additionally, the transceiver 66 or the mobile computing device 98 may transmit the weight of the suitcase 36 to the airline to facilitate a check-in procedure for the suitcase 36 with the airline.

Because the lock 68 is movable to the unlocked position by the master key, the user may be able to lock the suitcase 36 while allowing the suitcase 36 to remain accessible to entities responsible for inspecting luggage passing through airports, for example, the Transportation Security Administration (TSA). The TSA approves locks for which a manufacturer of the lock 68 provides the master key to the TSA.

The controller 64 may be programmed to instruct the transceiver 66 to transmit a signal indicating a location determined by the location sensor 76. The signal may be sent from the transceiver 66 to, e.g., the mobile computing device 98 of the user. The user may be able to use the location reported from the suitcase 36 to determine, for example, whether the suitcase 36 has been transported from a tarmac to a baggage claim area of an airport after a flight, whether the suitcase 36 has been routed to an incorrect final destination by an airline, etc.

The controller 64 may be programmed to activate the alarm 78 in response to a signal received by the transceiver 66. The signal may be received by the transceiver 66 from, e.g., the mobile computing device 98 of the user. The user may transmit the signal if, for example, the user wants to find the suitcase 36 among a large number of other suitcases in the baggage claim area.

The controller 64 may be programmed to instruct the lock 68 to move between the unlocked position and the locked position in response to a signal received by the transceiver 66. The signal may be received by the transceiver 66 from, e.g., the mobile computing device 98 of the user. The user may transmit the signal to lock 68 or unlock the suitcase 36 before or after the suitcase 36 will be handled by other individuals than the user.

In general, the computing systems and/or devices, e.g., the controller 64, described may employ any of a number of computer operating systems, including, but by no means limited to, versions and/or varieties of the Ford SYNC® application, AppLink/Smart Device Link middleware, the Microsoft® Automotive operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A system comprising:

a docking station installable in a cargo area of a vehicle and electrically connectable to a power source of the vehicle; and a suitcase including a port engageable with the docking station;

a battery electrically connected to the port;

an electric motor electrically connected to the battery;

a wheel connected to the electric motor;

a weight sensor; and a controller in communication with the electric motor, the wheel, and the weight sensor;

wherein the controller is programmed to instruct the electric motor to rotate the wheel based at least on a weight signal from the weight sensor.

2. The system of claim 1, wherein the suitcase includes an exterior and a door movable relative to the exterior between an opened position and a closed position.

3. The system of claim 2, wherein the door in the opened position is retracted along the exterior.

4. The system of claim 2, wherein the suitcase includes a lock movable between a locked position engaged with the exterior and the door in the closed position and an unlocked position disengaged with at least one of the exterior and the door.

5. The system of claim 4, wherein the lock is movable to the unlocked position via a master key and one of a personal key and a combination.

6. The system of claim 4, wherein the controller is in communication with the lock, and the lock is configured to be movable between the unlocked position and the locked position in response to a signal from the controller.

7. The system of claim 6, wherein the suitcase includes a transceiver in communication with the controller, and the controller is programmed to instruct the lock to move between the unlocked position and the locked position in response to a signal received by the transceiver.

8. The system of claim 1, wherein the controller is programmed to instruct the electric motor to rotate the wheel based at least on torque applied to the wheel.

9. The system of claim 1, wherein the suitcase includes a tilt sensor in communication with the controller, and the controller is further programmed to instruct the electric motor to rotate the wheel based at least on a tilt signal from the tilt sensor.

10. The system of claim 1, wherein the suitcase includes a transceiver in communication with the controller, and the controller is programmed to instruct the transceiver to send a signal indicating a weight of the suitcase based on a signal from the weight sensor.

11. The system of claim 1, wherein the suitcase includes a transceiver in communication with the controller.

12. The system of claim 11, wherein the suitcase includes an alarm in communication with the controller, and the controller is programmed to activate the alarm in response to a signal received by the transceiver.

13. The system of claim 11, wherein the suitcase includes a location sensor in communication with the controller, and the controller is programmed to instruct the transceiver to transmit a signal indicating a location determined by the location sensor.

14. The system of claim 1, wherein the suitcase includes a light in communication with the battery, wherein the light is programmed to illuminate based on a state of charge of the battery.

15. The system of claim 1, wherein the suitcase includes a second port electrically connected to the battery and engageable with a mobile computing device.

16. The system of claim 1, further comprising the vehicle including the cargo area and the power source, wherein the docking station is installed in the cargo area and connected to the power source.

* * * * *